United States Patent [19]

Taurisano

[11] 4,410,118

[45] Oct. 18, 1983

[54] UNIVERSAL HOLSTER ASSEMBLY

[76] Inventor: Michael P. Taurisano, 163 Oxford Rd., New Hartford, N.Y. 13413

[21] Appl. No.: 474,803

[22] Filed: Mar. 14, 1983

[51] Int. Cl.[3] ..... F41C 33/02; F41B 13/04

[52] U.S. Cl. ..... 224/222; 224/192; 224/243; 224/206; 224/911

[58] Field of Search ..... 224/206, 208, 222, 243, 224/192, 911, 901, 229

[56] References Cited

U.S. PATENT DOCUMENTS

| | | | |
|---|---|---|---|
| 4,022,361 | 5/1977 | Devlin | 224/192 |
| 4,029,242 | 6/1977 | Stoesser | 224/222 |
| 4,258,871 | 3/1981 | McMahon | 224/911 X |

*Primary Examiner*—Steven M. Pollard

*Attorney, Agent, or Firm*—Burns & Jenney

[57] ABSTRACT

A holster system for a handgun that permits the gun to be safely carried and drawn from any one of three conventional modes of carry without the need of special fixtures.

7 Claims, 6 Drawing Figures

UNIVERSAL HOLSTER ASSEMBLY

BACKGROUND OF THE INVENTION

This invention relates to an improved holster assembly for a handgun and, in particular, to a universal holster assembly that makes it possible to safely and rapidly utilize any one of three distinct modes of carry.

As described by Bianchi in U.S. Pat. No. 4,084,734, many holsters are presently available that can be selectively worn either under the arm or at the hip. Stoesser in U.S. Pat. No. 4,029,242 discloses a leg holster wherein the holster body is suspended between a pair of leg encircling straps which coact to prevent the weapon from bouncing as the leg is moved. This leg mount, however, generally supports the weapon relatively high up on the leg and as a result it is difficult to withdraw the weapon from the holster. In U.S. Pat. No. 4,258,871 to McMahon, a holster assembly is shown wherein the holster body is snapped into a separate holster positioner and support member having vertically extended straps for attaching the member to some part of a body harness. The snap fasteners used by McMahon oftentimes become worn with usage and may eventually fail to allow the weapon to fall and possibly accidently discharge. Furthermore, this type of mount permits the holster body and weapon stored therein to be easily separated from the harness. Clearly, this arrangement would be unsuitable for use by a law enforcement official where, under emergency situations, retension of the weapon is of paramount importance. Lastly, the outwardly extended mounting straps used by McMahon make it difficult to conceal the holster when it is worn in any one of the three traditional carrying positions.

Although some holster assemblies can be utilized in one or even two modes of carry, none of these devices provides for the secure and safe retention of a handgun in each one of the three well known and accepted concealed carrying positions. These positions include the hip position wherein the holster is mounted upon a waist encircling belt, the underarm position wherein the holster is mounted upon a shoulder harness and an ankle position wherein the holster is mounted upon a leg encircling device. Typically, most people who are required to carry a handgun as part of their professional duties, are quite familiar with these three positions and through continuous practice with the weapon, become conditioned to quickly and safely draw the weapon from any one of these positions using a natural response. A natural response may be described as a movement that enables the user to remove the weapon from the holster body with a natural sweeping motion of the arm without having to contort or unnaturally position the body. A truly universal holster that allows the user to draw a secured weapon from any concealed carry position has heretofore not been realized in the art.

SUMMARY OF THE INVENTION

It is therefore an object of the present invention to improve handgun holster systems.

A further object of the present invention is to provide a universal handgun holster assembly that provides for a natural draw when worn in any one of the three accepted concealed modes of carry utilized by law enforcement officials and the like.

A still further object of the present invention is to improve the safety of carrying and drawing a weapon concealed on the body.

Yet another object of the present invention is to provide a concealable holster assembly that can be worn on the hip, on the leg or under the arm without impeding the wearer's natural response to remove a weapon from the holster.

Another object of the present invention is to provide a single holster assembly that is easily and safely adapted for use in three separate modes of carry without having to sacrifice conditioned draw reflexes or changing the basic physical characteristics of the holster body.

These and other objects of the present invention are attained by a universal holster system that allows a handgun to be safely and quickly drawn with a natural motion from any one of three concealed carry positions. The system includes a holster body having a weapon receiving pocket, a belt receiving slot and a pair of rings for mounting the body in an underarm position upon a shoulder harness. The body is mountable upon a leg support having a soft back and pad that partially encircles the leg above the ankle, a body receiving belt secured at its proximal end along one side margin of the pad and which passes beneath a belt loop affixed to the front surface of the pad. The holster is positioned between the proximal end of the belt and the belt loop and the distal end of the belt is brought around the leg and through a reversing buckle secured to the pad adjacent to the proximal end of the belt so that the belt can be turned about the buckle back upon itself to superimpose the distal end of the belt in a face-to-face relationship. A Velcro fastener is mounted upon the superimposed belt surfaces by which the belt can be selectively tightened about the leg.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
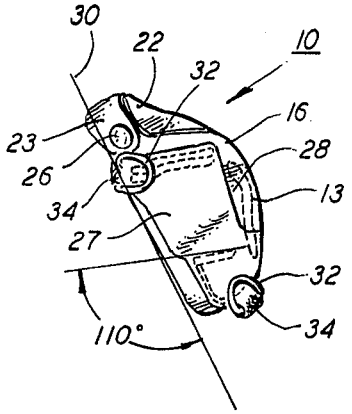
FIG. 1 is a side elevation of the holster body utilized in the present invention showing the back of the holster body and further illustrating the shoulder harness securing rings in a retracted position.
Figure 3:
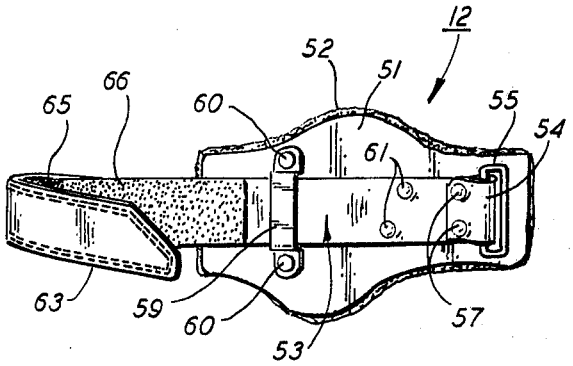
FIG. 3 is a side elevation of a leg support for securing the holster body to the leg of the wearer.
Figure 2:
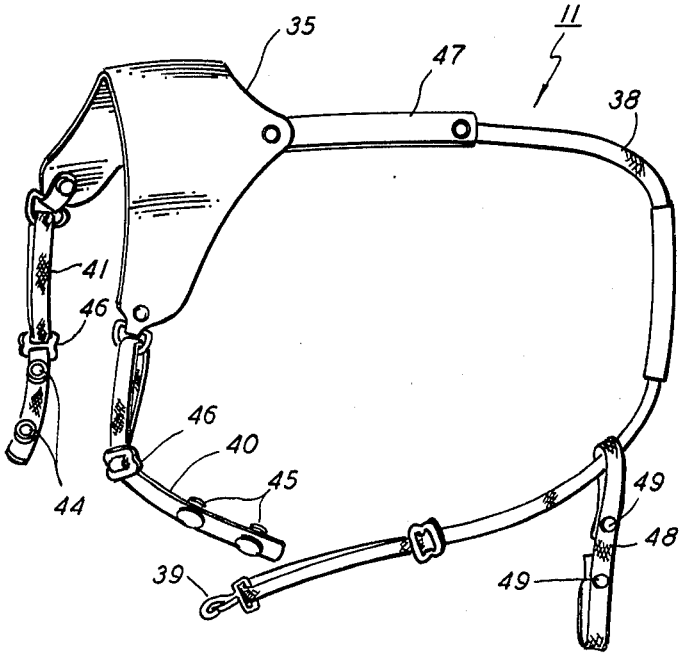
FIG. 2 is a perspective view of a shoulder harness for suspending the holster body of FIG. 1 under the arm of a wearer.
Figure 6:
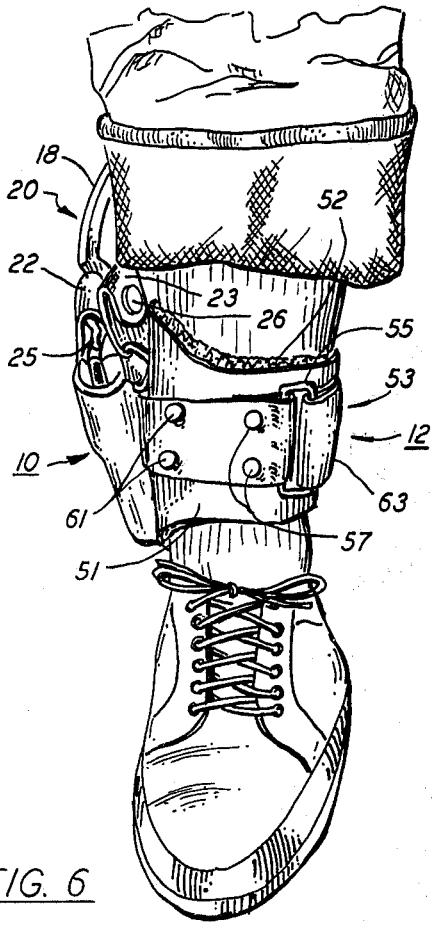
FIG. 6 is a partial view showing the holster body of FIG. 1 mounted upon the leg of the wearer using the leg support shown in FIG. 3.
Figure 4:
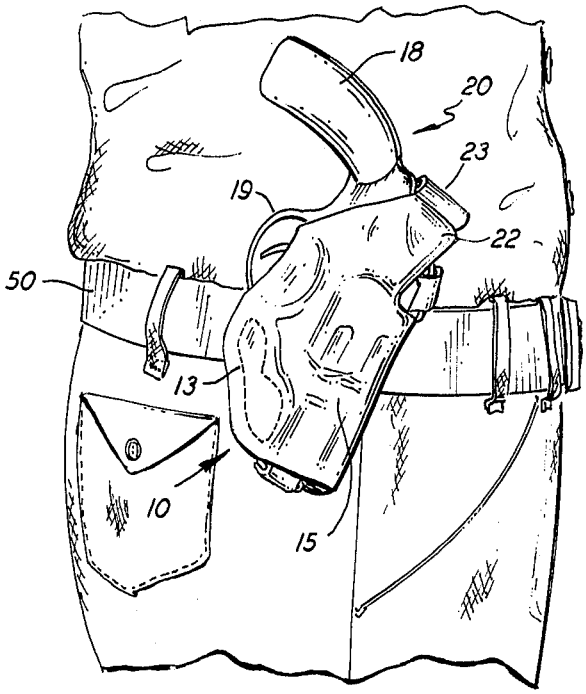
FIG. 4 is a partial view showing the holster body of FIG. 1 mounted upon a waist belt in a hip position.
Figure 5:
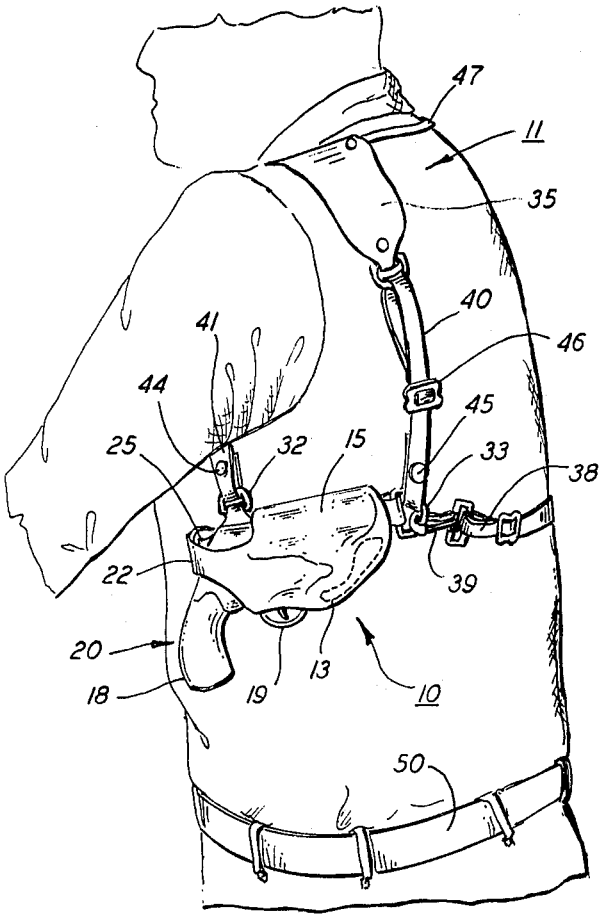
FIG. 5 is also a partial view showing the holster body of FIG. 1 suspended beneath the arm of the wearer using the shoulder harness shown in FIG. 2.

With further reference to the drawings, there is illustrated in FIGS. 1–3 three major components of the present universal holster system that includes a holster body 10, a shoulder harness 11, and a leg support 12. As will be explained in greater detail below, the leg support is specifically designed to secure the holster body to the leg of the wearer without the need of special fixtures, snaps and the like. As a result, the holster body is capable of being worn, at the wearer's option, in any one of the three generally accepted carrying modes used by law enforcement peopel and others who have a need to keep a handgun in a concealed position. These modes of carry are generally referred to as the hip position as illustrated in FIG. 4, the underarm position as illustrated in FIG. 5 and the ankle position as illustrated in FIG. 6.

As previously noted, although many holster designs offer a single or dual carrying option, none offer three safe and truly functional concealed draw positions. The main reason for this apparent shortcoming in the art lies in the fact that most holster bodies must be altered considerably in order to adapt them for use in the ankle position. This in turn renders the body section unwieldy or unsuited for use in the other two carry modes. By the same token, if the body is well adapted for concealment in a hip or an underarm carry, it cannot be securely held to the ankle in a posture that is not only safe but also permits the weapon to be rapidly drawn using a natural motion of the arm and body. The present invention makes it possible to utilize the holster body in any selected mode of carry familiar to handgun users without departing from previously learned conditioned responses. In addition, the holster also retains all the physical characteristics of size and shape that handgun users are so familiar with. The holster can thus be quickly adapted for use without having to retrain the user.

The holster body shown in FIG. 1 is preferably fabricated from a single piece of precut leather that is folded back upon itself and sewn along the seam 13 to form a weapon receiving pocket having a front face 15 and a back face 16. The pocket is open at the top and partially along one side edge to provide free access to the grip 18 and trigger mechanism 19 of a weapon 20 housed therein. A pair of dependent outwardly extended tabs 22 and 23 are adapted to enclose the hammer 25 of a weapon housed within the pocket. A snap fastener 26 of conventional design is used to cojoin the tabs and thus positively secure the handgun in the holster. The snap fastener can be quickly released by a simple thumb action as the handgun is being drawn.

As best seen in FIG. 1, a wide strip of leather is also sewn into the back face of the holster body to form a belt receiving annulet 27. An elongated slot 28 is provided between the back surface of the holster body and strip through which a belt can be threaded. The width of the loop strip is approximately equal to that of the holster body allowing for a maximum amount of belt contact to be maintained against the holster thus providing a stable housing for the weapon. The passageway through the belt loop is canted in regard to the central axis 30 of the holster body as generally defined by the side margin of the body that is adjacent to the barrel of a handgun housed therein. As shown in FIG. 4, by slightly canting the belt receiving passageway, the weapon will be tilted slightly forward when the holster is mounted on the user's gun hand hip. By offsetting the passage at an angle of about 110° from the axis 30 of the holster body, the weapon will be tilted forward on the hip to a position where it can be withdrawn from the holster safety using a natural hand motion. As will be explained below, this forwardly tilting position is also of advantage when the holster body is mounted in an ankle position.

A pair of retractable D-rings 32 and 33 are also secured to the back of the holster by means of retainers 34–34. As shown, the lower D-ring 32 is secured to the bottom edge of the holster body while the upper D-ring 33 is similarly secured to the top of the body at the barrel side edge adjacent to the hammer enclosing tabs. Each ring is able to swing within its retainer between an extended position wherein the ring protrudes beyond the peripheral margin of the holster and a stored position wherein the ring is turned under the holster body. When in the stored position, the ring lies flat against the back surface of the body and when extended, the rings enable the holster body to be operatively attached to the shoulder harness 11 shown in FIG. 2. The harness operates in a conventional manner and includes a triangular shoulder rest 35 that is adapted to be seated upon the shoulder opposite the gun hand as shown in FIG. 5. An adjustable shoulder strap 38 is passed behind the neck of the user over the opposite shoulder and under the gun hand arm. After passing under the arm, the shoulder strap is brought across the back and is clipped to the lower D-ring 32 on the holster body using a spring clip 39. A pair of hanger straps 40 and 41 are adapted to hang down from the shoulder rest to either side of the off-gun hand shoulder. Front hanger strap 41 is passed through the top D-ring 32 on the holster and is fastened in place using a conventional snap fastener 44. The back hanger strap 40 is similarly passed through the lower D-ring 33 and secured in place using a second snap fastener 45 thus suspending the holster body under the user's arm. Each of the hanger straps is provided with an adjusting shoe 46 that allows the holster body to be adjustably positioned under the arm.

An elastic expander 47 is used to attach the shoulder strap to the rest. A tie down strap 48, having a pair of snap fasteners 49–49, is used to tension the shoulder strap in assembly. The tie down strap is fastened between the shoulder strap and the user's waist belt 50 to place a slight amount of tension on the elastic expander and thus hold the harness securely in place.

Turning now to FIGS. 3 and 6, there is illustrated a leg band support 14 for securely holding the above described holster body to the user's leg just above the ankle. The band includes a contoured ankle pad 51 that has a circumferential length such that the pad is capable of being wrapped about the leg to at least partially encompass that portion of the leg directly over the ankle. A fleece backing 52 is secured to the back surface of the pad and during use is seated in contact against the leg to provide a soft pliable interface that permits the pad to be held tightly against the leg without chafing. The backing is preferably formed of sheep wool or any other suitable material that will allow air to pass into the contact region.

An elongated ankle belt is secured at its proximal end 54 to the front face of the pad along its right front margin as shown in FIG. 3. The proximal end of the belt is further looped through a reversing buckle, the purpose of which will be explained below, and is affixed to the pad by use of rivets 57—57. A belt loop 59 is riveted to the front face of the pad by rivets 60—60 a predetermined distance from the proximal end of the belt. In assembly the holster body is threaded onto the belt and the body brought tight against a pair of offset locating rivets 61—61 that are affixed between the belt and pad. The belt is then passed through the belt loop to draw the body of the holster tightly against the pad. The distance between the locating rivets and the belt loop is slightly greater than the width of the holster body belt annulet 27 (FIG. 1) thus preventing the holster body from moving laterally on the pad. The height of the pad is about equal to the axial length of the holster body whereby the body of the holster is seated in contact entirely against the soft back pad. In assembly, the retractable D-rings on the holster body are placed in a stored position between the holster and the pad where they will not interfere with the removal of the weapon or snag on the wearer's clothing.

The free or distal end 63 of the ankle belt is brought around the leg and passed through the reversing buckle so that the belt can be folded back upon itself. Two strips of Velcro 65 and 66 are sewn in a side-by-side alignment to the front face of the belt. One Velcro strip is a male or hook section while the other is a female or pile section. With the belt turned through the reversing buckle, the belt is drawn taut to tighten the ankle pad securely against the leg and the Velcro section then placed in face-to-face contact to fasten the ankle pad and holster body in place. As can be seen, the soft backing of the pad is thus pulled tightly into conformity with the contour of the leg to securely hold the weapon against the inside of the leg above the ankle. Through the use of the locating rivets 61—61, the weapon in this position is held at the same angle as when the unit is mounted on the waist belt and thus then maintains the familiar and accustomed angle of the handgun grip for drawing. This angle, when maintained on the ankle pad, also facilitates the concealing of the handgun grip when worn on the ankle.

While this invention has been described with reference to the details as set forth above, it is not limited to the specific structure as disclosed and the invention is intended to cover any modifications or changes as may come within the scope of the following claims.

I claim:

1. A universal holster for carrying a handgun that comprises in combination a holster body having an interior pocket for housing a handgun and an opening in the upper portion thereof for providing access to the grip of the handgun, retainer tabs disposed outwardly from the upper portion of the body for substantially encircling the hammer of the handgun, a belt receiving slot contained in the body for slidably receiving a belt therein, and a leg support means having a relatively wide pad for partially encircling a human leg above the ankle, a soft, pliable backing material covering the back of the pad, a belt for slidably receiving the holster body thereon which is affixed at its proximal end to a side edge of the pad, said belt passing across the outer surface of the pad beneath a belt loop affixed to said outer surface whereby the holster body is positionable between the loop and the proximal end of the belt, a reversing buckle secured to the pad adjacent to the proximal end of the belt to permit the distal end of the belt to be passed about the leg and turned through the buckle back upon itself, adjustable fastening means for securing the turned distal end of the belt to itself whereby the pad can be tightened against the leg.

2. The universal holster of claim 1 wherein said fastening means is a Velcro fastener having a male element secured to one opposed section of the belt and a female element secured to another section of the belt.

3. The universal holster of claim 1 wherein said leg support means further includes a locating means mounted on said pad between the belt loop and the proximal end of the belt for positioning the holster body on the leg and preventing said holster body from sliding on the belt once the pad is secured to the leg.

4. The universal holster of claim 1 that further includes a thumb actuated snap means acting between said tabs for securing the tabs about the hammer of a handgun housed in said holster body.

5. The universal holster of claim 1 wherein the backing material of the leg support means is fleece wool.

6. The universal holster of claim 1 wherein the height of the pad between the proximal end of the belt and the belt loop is substantially equal to the length of the holster body.

7. The universal holster of claim 1 that further includes a first retractible ring secured to the bottom of the holster body and a second retractible ring secured at the top of the holster body, said rings capable of being moved between a fully extended position and a stored position under the back surface of the holster body when not in use, a shoulder harness for attachment to the upper torso of a human body having a pair of hanger straps extending downwardly to either side of a shoulder rest, and connecting means for joining the rings when in an extended position to the hanger straps for suspending the holster body under an arm of said torso.

* * * * *